US007038156B2

(12) United States Patent
Kim et al.

(10) Patent No.: US 7,038,156 B2
(45) Date of Patent: May 2, 2006

(54) ROTARY KNOB ASSEMBLY FOR HOME APPLIANCE

(75) Inventors: Shin Kim, Changwon-si (KR); Bong Sang Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/926,401

(22) Filed: Aug. 26, 2004

(65) Prior Publication Data

US 2005/0077166 A1 Apr. 14, 2005

(30) Foreign Application Priority Data

Aug. 27, 2003 (KR) ..... 10-2003-0059524
Aug. 27, 2003 (KR) ..... 10-2003-0059525

(51) Int. Cl.
*H01H 15/02* (2006.01)

(52) U.S. Cl. ..... 200/564; 200/567

(58) Field of Classification Search ..... 200/336, 200/561, 564, 567, 38 D, 19.08, 19.07, 50.32, 200/50.34, 316, 317, 19.12
See application file for complete search history.

(56) References Cited

U.S. PATENT DOCUMENTS 3,729,728 A * 4/1973 Hardway, Jr. ..... 340/870.37
3,986,372 A * 10/1976 Karklys ..... 68/12.21
4,748,296 A * 5/1988 Cutler et al. ..... 200/6 B
5,161,393 A * 11/1992 Payne et al. ..... 68/12.04
5,325,677 A * 7/1994 Payne et al. ..... 68/12.04
5,464,955 A * 11/1995 Cole ..... 200/317
5,481,169 A * 1/1996 Turetta et al. ..... 318/560
5,668,359 A * 9/1997 Alvord et al. ..... 200/6 B
6,143,999 A * 11/2000 Uleski et al. ..... 200/296
6,158,802 A * 12/2000 Akagi et al. ..... 296/214
6,410,871 B1 * 6/2002 Rarbach ..... 200/336
6,727,443 B1 * 4/2004 Peterson et al. ..... 200/50.34
6,727,449 B1 * 4/2004 Spiegel et al. ..... 200/336
6,862,482 B1 * 3/2005 Peterson et al. ..... 700/19
2003/0024796 A1 * 2/2003 Peterson et al. ..... 200/11 R
2003/0028270 A1 * 2/2003 Peterson et al. ..... 700/83
2004/0257068 A1 * 12/2004 Wolber et al. ..... 324/207.12
2005/0035836 A1 * 2/2005 Howard et al. ..... 335/205

FOREIGN PATENT DOCUMENTS

EP 476423 * 3/1992
JP 05137877 * 6/1993
JP 10146491 * 6/1998
JP 10328477 * 12/1998
JP 2001270428 * 10/2001

* cited by examiner

*Primary Examiner*—Michael Friedhofer
*Assistant Examiner*—Lisa Klaus
(74) *Attorney, Agent, or Firm*—McKenna Long & Aldridge LLP

(57) ABSTRACT

Disclosed is a rotary knob assembly for a home appliance. The assembly includes a rotary switch having an encoder and a shaft rotatably installed at the encoder, a knob coupled to the shaft of the rotary switch, and a support member provided around the rotary switch to support the rotary switch.

32 Claims, 4 Drawing Sheets

ROTARY KNOB ASSEMBLY FOR HOME APPLIANCE

This application claims the benefit of Korean Applications No. P2003-0059520, filed on Aug. 27, 2003, and No. P2003-0059521, filed on Aug. 27, 2003, which are hereby incorporated by reference.

BACKGROUND OF THE INVENTION

1. Field of the Invention

The present invention relates to a home appliance, and more particularly, to a rotary knob assembly mounted at a control panel of a home appliance.

2. Discussion of the Related Art

Generally, a home appliance includes a control panel assembly. The control panel assembly is used to instruct an operation and display an operation state of the home appliance. The control panel assembly is comprised of a panel part exposed to a user and a substrate housed within the panel part. The substrate has a switch electrically connected with a controlling unit and a display device for displaying an operation state, which are installed thereat. Various mechanical switches are provided at the panel part to operate the electric switch of the substrate. As the mechanical switch, there are a rotary knob assembly, a slider assembly, a press button assembly and the like. Specifically, the rotary knob is rotatably installed at the panel part, and is used to select a specific function or control a level of the selected function according to a control amount of the knob.

In the rotary knob assembly, the rotary switch is generally installed on the substrate. The rotary switch includes an encoder and an encoder shaft rotatably coupled to the encoder. Additionally, a knob is coupled to the encoder shaft for a user's manipulation.

However, a heavy and large knob is directly coupled to the rotary switch, and the rotary switch is not enough supported by the substrate or the panel. Accordingly, if a great force is applied to the home appliance or the knob assembly, the rotary switch is easily destroyed. Specifically, if a great impact is laterally applied on the moment, the rotary switch can be partially deformed by the knob or be detached from the substrate.

Further, due to the same reason, the knob is not stably supported by the rotary switch. Accordingly, since the knob is greatly shaken left and right, it is erroneously manipulated.

SUMMARY OF THE INVENTION

Accordingly, the present invention is directed to a rotary knob assembly for a home appliance that substantially obviate one or more problems due to limitations and disadvantages of the related art.

An object of the present invention is to provide a rotary knob assembly in which a rotary switch is stably supported.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a rotary knob assembly for a home appliance, the assembly including a rotary switch having an encoder and a shaft rotatably installed at the encoder, a knob coupled to the shaft of the rotary switch; and a support member provided around the rotary switch to support the rotary switch, wherein the support member is configured to support a side portion of the rotary switch.

The support member supports the rotary switch such that the rotary switch is not damaged by a force applied to a side surface thereof. Moreover, the support member may provide support for the rotary switch and the knob, alternatively, the support member may provide support for either the rotary switch or the knob. Further, the support member is formed normal to the side surface of the rotary switch, and is formed to enclose at least a portion of the rotary switch.

More particularly, the support member is configured to support a side portion of the encoder. For this, the support member is formed normal to the side portion of the encoder, and is closely in contact with the side portion of the encoder.

The support member has a first rib configured to support at least a portion of the side portion of the encoder. The first rib is formed normal to the side portion of the encoder, and may be formed to entirely enclose the side portion of the encoder. Further, the support member has a first extension part extended along the encoder to support the encoder. Preferably, the first extension part supports the side portion of the encoder.

Furthermore, the support member is configured to support a circumferential portion of the shaft. For this, the support member is formed normal to the circumferential portion of the shaft, and has a predetermined clearance with respect to the circumferential portion of the shaft.

The support member has a second rib configured to support at least a portion of the circumferential portion of the shaft. Preferably, the second rib is formed normal to the circumferential portion of the shaft, and is formed to support an upper portion of the encoder. Further, the second rib is formed to enclose the circumferential portion of the shaft. Furthermore, the support member has a second extension part extended along the shaft to support the shaft, and the second extension part is formed to enclose the shaft.

Alternatively, the support member is configured to additionally support the knob. For this, the second extension part is additionally extended to reach the knob. Further, the support member is configured to support at least one lamp disposed around the knob for displaying an operation state of the home appliance, and accordingly, the support member has a housing for accommodating the lamp.

According to the present invention, since the rotary switch is stably supported, the encoder is not damaged or the shaft is not deformed. Further, the knob can be stably and accurately rotated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
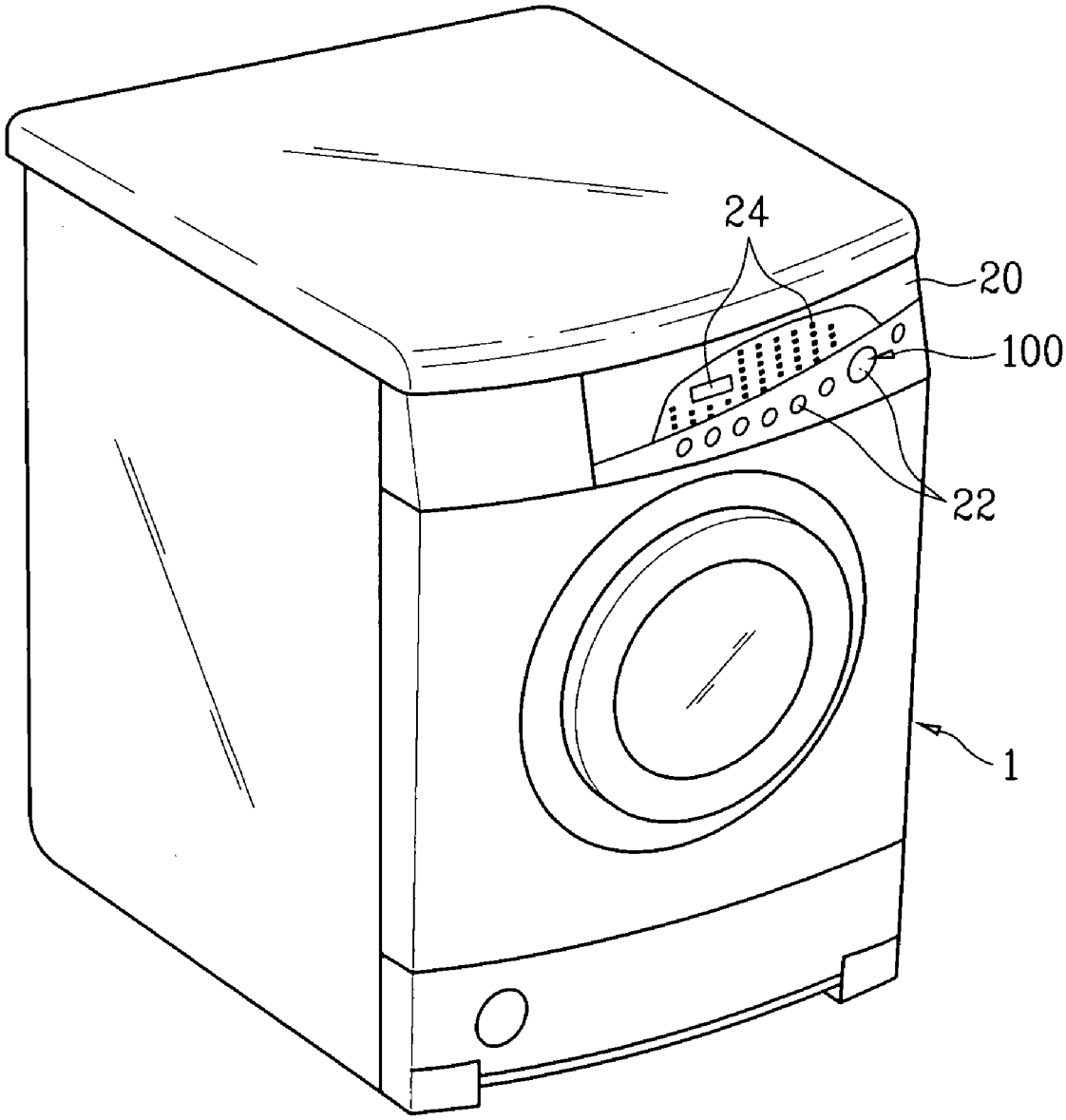
FIG. 1 is a perspective view illustrating a control panel assembly including a rotary knob assembly and a home appliance according to the present invention.
Figure 2:
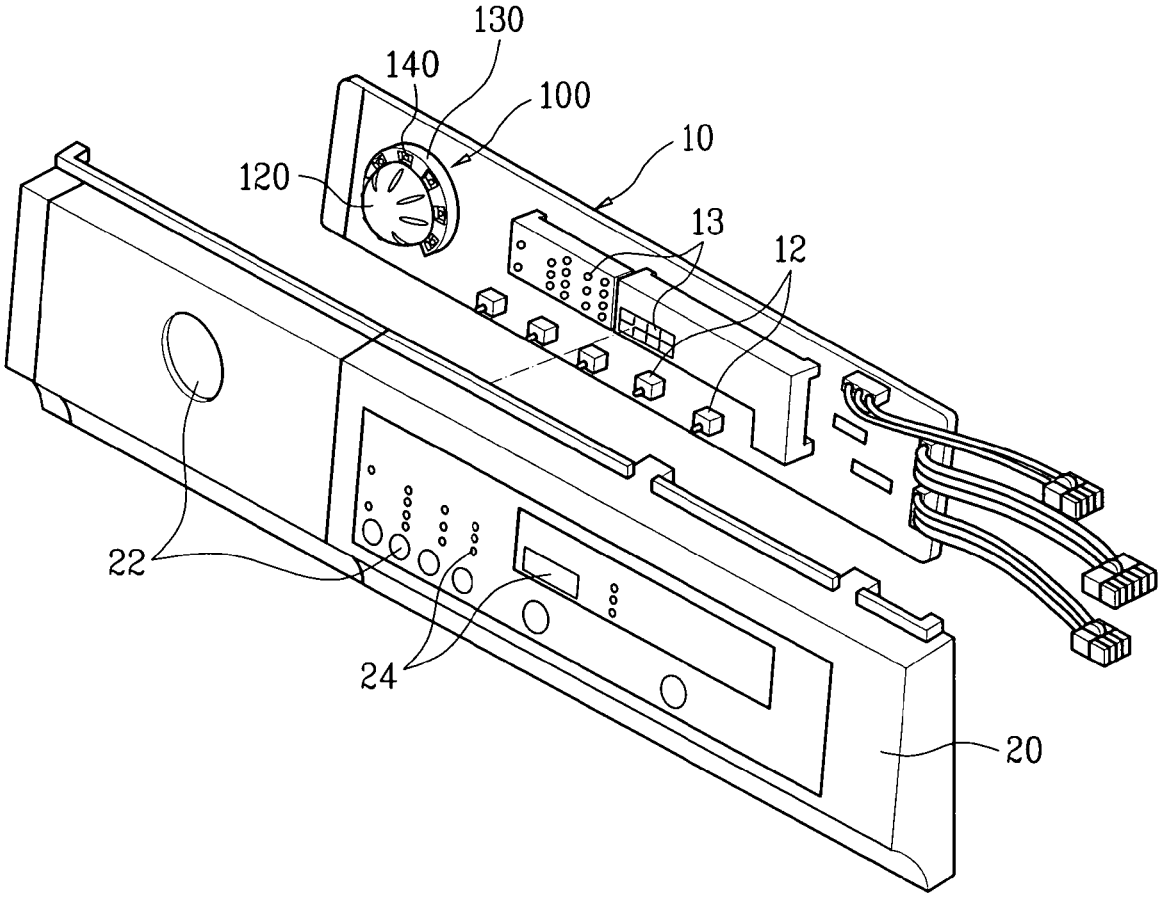
FIG. 2 is a disassembled perspective view illustrating a control panel assembly of FIG. 1.

FIG. 1 is a perspective view illustrating a control panel assembly including a rotary knob assembly and a home appliance according to the present invention, and FIG. 2 is a disassembled perspective view illustrating a control panel assembly of FIG. 1. As known to the related art, in the rotary knob assembly, only a size and shape is generally varied depending on a kind of a home appliance. Accordingly, the present invention is described with reference to an embodiment applied to a washing machine as follows for description convenience, but can be identically applied to other home appliances.

FIG. 1 illustrates a generally washing machine 1. Generally, a washing machine performs washing, rinsing and dewatering so as to separate dirt from clothes by the interaction of detergent and water. In such a washing machine, a drum accommodating laundry is disposed inside a tub containing washing water therein, and the laundry is washed while the drum rotates inside the tub. Specifically, the washing machine 1 is a front loading type washing machine having the drum laid down to load the laundry in or out through the front of the washing machine 1. In the washing machine 1, the laundry is not almost damaged and tangled. The washing machine 1 has a control panel assembly for instructing an operation and displaying an operation state in the same manner as other home appliances.

Referring to FIG. 2, the control panel assembly for the home appliance is broadly comprised of a substrate 10 and a control panel 20 which are functionally coupled with each other.

First, the substrate 10 forms a bottom portion of the control panel assembly, and supports various parts installed within the assembly. A switch 12 that is a part for manipulating the home appliance and a display device 13 that is a part for displaying the operation state of the home appliance are installed on the substrate 10. The switch 12 outputs a signal necessary for an operation of the home appliance, and the display device 13 emits light or displays predetermined information. Specifically, in case where the inventive control panel assembly is applied to the washing machine, waterproof is more important above all things to prevent out-of-order. Accordingly, it is desirable to form a waterproof layer on the substrate 10 such that the switch 12 and the display device are not in contact with water. The waterproof layer can be formed of various materials, but is generally formed of Urethane.

The control panel 20 covers the substrate 10, and is exposed to a user for his/her manipulation. Further, the control panel 20 is configured such that the user is accessible to the switch 12 and the display device 13, that is, the user can operate the switch 12 or obtain information from the display device 13. For this, the control panel 20 has at least one through-hole 22. The through-hole 22 is provided at a position corresponding to the switch 12 of the substrate 10. Further, at least one display window 24 is provided at the control panel 20, and the display window 24 is provided at a position corresponding to the display device 13 of the substrate 10. Character, figure and color can be implemented on the control panel 20, specifically, the through-hole 22 and the display window 24 to assist a use of a user's home appliance. More particularly, a button assembly and/or the rotary knob assembly 100 are installed at the through-hole 22 as shown in the drawings. The rotary knob assembly 100 is a kind of input device for instructing an operation of the washing machine in the same manner as the button assembly and generating an electric signal by using mechanical rotation. That is, the rotary knob assembly 100 generates a different electric signal depending on an amount of rotation, and can selectively instruct a plurality of functions or continuously control a level of the selected function. For example, the rotary knob assembly of the washing machine can be applied to select any one of various washing courses or control time taken for the selected washing course. The inventive rotary knob assembly 100 is in detail described with reference to the drawings as follows.

Figure 3:
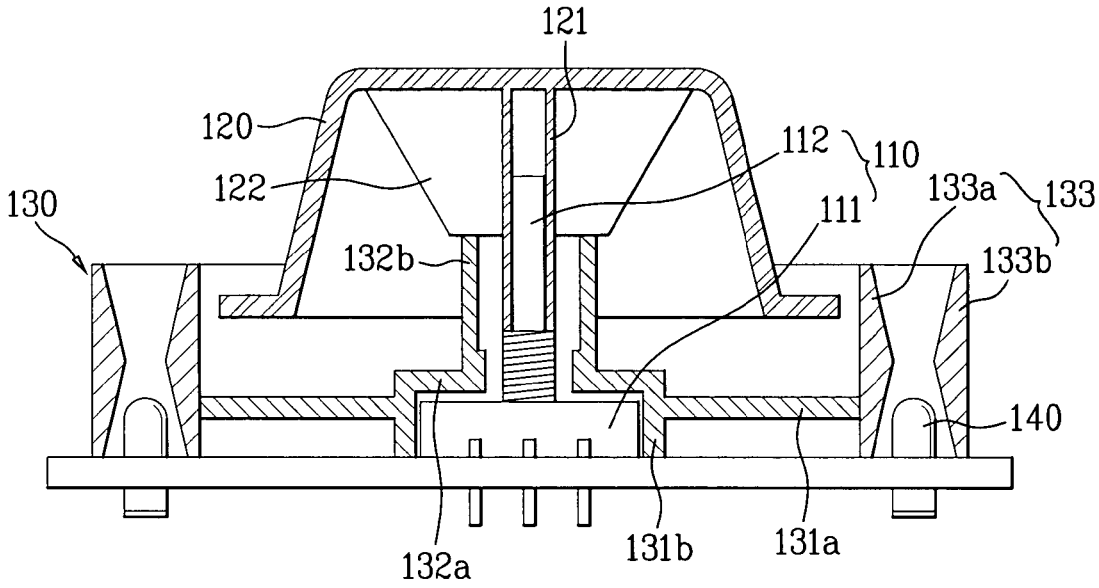
FIG. 3 is a sectional view illustrating a rotary knob assembly according to the present invention.
Figure 4:
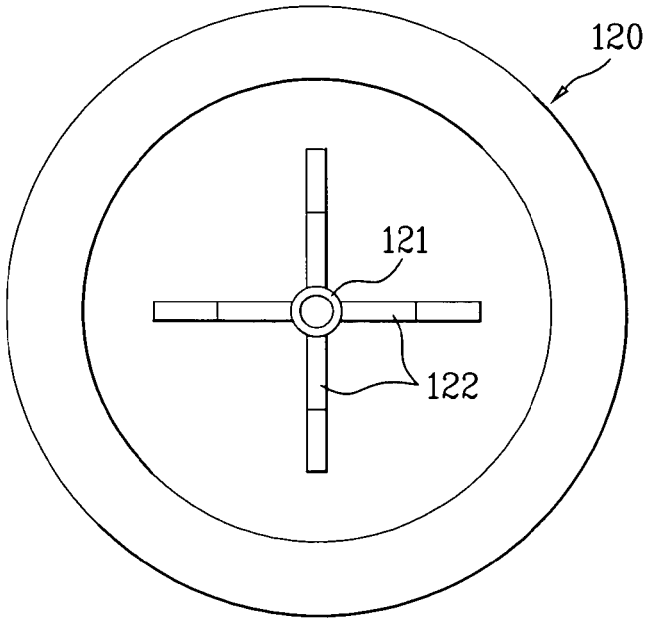
FIG. 4 is a rear view illustrating a rotary knob assembly according to the present invention.
Figure 5:
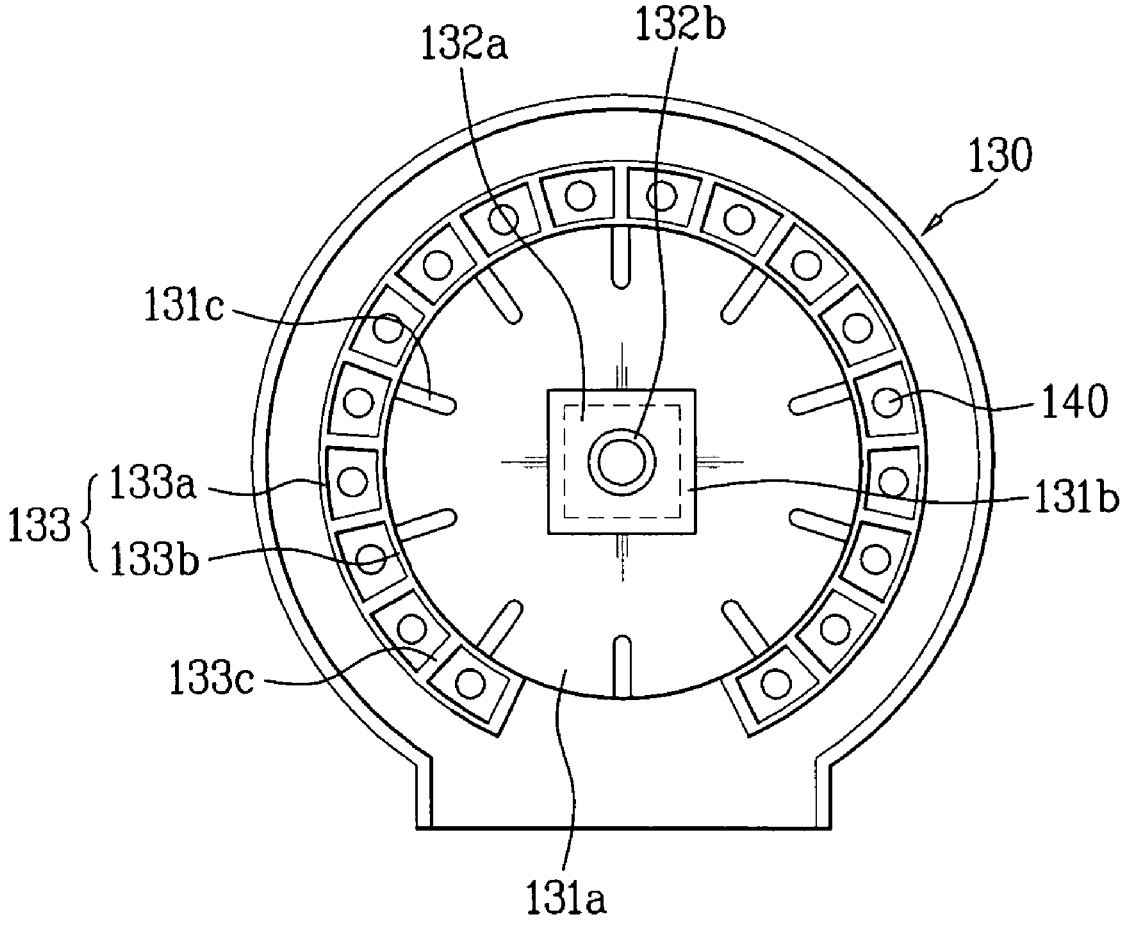
FIG. 5 is a plan view illustrating a support member of a rotary knob assembly according to the present invention.

FIG. 3 is a sectional view illustrating a rotary knob assembly according to the present invention, FIG. 4 is a rear view illustrating a rotary knob assembly according to the present invention, and FIG. 5 is a plan view illustrating a support member of a rotary knob assembly according to the present invention.

The rotary knob assembly 100 is comprised of a rotary switch 110 installed between the substrate 10 and the panel 20, a knob 120 and a support member 130.

First, the rotary switch 110 includes an encoder 111 and a shaft 112. The encoder 111 is fixed on the substrate 10, and the shaft 112 is rotatably installed at the encoder 111. Accordingly, the encoder 111 coupled with the shaft 112 depending on the amount of rotation generates different electric signals, that is, pulse signals, and the generated signals are transmitted to a control unit, which is electrically connected to the rotary switch 110, to perform a designated function at each signal.

The knob 120 includes a body and a boss 121 provided at the body. Additionally, as shown in FIGS. 3 and 4, a reinforcing rib 122 is provided between the boss 121 and the body to reinforce strength of the knob 120. The knob 120 uses the boss 121 to be coupled with the shaft 112 of the rotary switch. Accordingly, the user can turn the knob 120 at a predetermined angle to rotate the shaft 112, thereby allowing the rotary switch 110 to generate an electric signal corresponding to a desired function.

The support member 130 is disposed around the rotary switch 110, and basically supports the rotary switch 110. As aforementioned, since the rotary switch 110 is not enough supported while being directly coupled to the substrate 10, it does not have a firm combination to the substrate and becomes very weak against a weight given to the rotary knob assembly 100, that is, against a lateral impact. Accordingly, the support member 130 is configured to primarily support the encoder 111 that is a main part of the rotary switch. Specifically, the support member 130 supports a side portion of the encoder 111 to endure a lateral weight and impact, which is frequently generated while the knob assembly 100 is used. For this, the support member 130 substantially includes a first rib 131*a* configured to support a minimal portion of the side portion of the encoder 111. As shown in FIG. 3, the first rib 131*a* is extended normal to and is in contact with the side portion of the encoder 111 to substantially support the side portion of the encoder 111. Further, the first rib 131*a* can be formed to enclose the side portion of the encoder 111 to stably support the encoder 111. At this time, as precisely shown in FIG. 5, the first rib 131*a* functions as a flange enclosing the side portion of the encoder 111. Preferably, the first rib 131*a* can have a plurality of auxiliary ribs for reinforcing its strength. Further, the first rib 131*a* have a first extension part 131*b* that is extended along the side portion of the encoder 111 to support the encoder 111. The first extension part 131*b* increases a contact area with the side portion of the encoder 111 to allow the support member 130 to more stably support the encoder 111. The first extension part 131*b* can partially support the side portion of the encoder 111, but is preferably configured to entirely enclose the side portion of the encoder 111. In this case, the first extension part 131*b* is substantially formed as a boss into which the encoder 111 is inserted. More preferably, the first extension part 131*b* and the first rib 131*a* are respectively closely in contact with the side portion of the encoder 111 to firmly support the encoder 111.

Due to the same reason, the shaft 112 as well as the encoder 111 is weak against the lateral weight and impact. Further, since the shaft 112 is directly connected to the knob 120 with a heavy weight and a large size, the shaft 112 can be easily influenced by the lateral weight and impact. Accordingly, the support member 130 is configured to support the shaft 112 of the rotary switch. More particularly, since the shaft 112 stands up to be coupled with the knob 120, the support member 130 supports a circumferential portion of the erected shaft 112 to endure the lateral weight and impact. For this, the support member 130 includes a second rib 132*a* configured to support a minimal portion of the circumferential portion of the shaft 112. The second rib 132*a* is extended normal to and is in contact with the circumferential portion to support the circumferential portion of the shaft 112 as shown in FIG. 3. As such, the normal extended second rib 132*a* can substantially support even an upper portion of the encoder 111 as shown in the drawings. Further, the second rib 132*a* can be formed to enclose the shaft 112 to stably support the shaft 112. At this time, the second rib 132*a* functions as the flange formed around the shaft 112 as shown in FIG. 5. Further, the support member 130 has a second extension part 132*b* that is extended from the second rib 132*a* along the shaft 112. The second extension part 132*b* increases a contact area with the shaft 112 to allow the support member 130 to more stably support the shaft 112. The second extension part 132*b* can partially support the shaft 112, but is preferably configured to entirely enclose the shaft 112. In this case, the second extension part 132*b* is substantially formed as a boss for the shaft 112. Further, in order to allow the shaft 112 to be rotated, it is desirable that the second extension part 132*b* and the second rib 132*a* have a predetermined clearance with respect to the shaft 112.

Further, the second extension part 132*b* can be more extended to reach the knob 120, and can additionally support the knob 120. More particularly, the second extension part 132*b* can be more extended to an internal of the knob 120 to support the boss 121 of the knob 120. Further, an end of the second extension part 132*b* can support up to the reinforcing rib 122 of the knob 120 as shown in FIG. 3. It is desirable that a supported portion, that is, a lower end of the reinforcing rib 122 is generally flat to be supported by the second extension part 132*b*. Accordingly, the knob 120 is stably supported together with the shaft 112 by the support member 130, more exactly, by the second extension part 132*b*. Accordingly, the knob 120 can be stably rotated not being shaken by the user.

Alternatively, at least one lamp 140 can be installed around the knob 120 to assist a user's use. The lamp 140 can allow the user to easily confirm the knob 120 at a dark place or at night. Alternatively, an operation of the selected function or a current level of the performed function is also displayed. Since the knob assembly 120 provides a multiple selection for a plurality of functions or levels, a plurality of lamps 140 are generally installed to display the function and the level. Since the lamp 140 is weak against the impact similar to the rotary switch 110, it is desirable that the support member 130 is configured to additionally support the lamps 140. More particularly, the support member 130 includes a housing 133 for housing the lamps 140. The housing 133 is comprised of an inner shell 133*a* and an outer shell 133*b*, which are spaced away from each other to provide a space for housing the lamps 140. Furthermore, a partition 133*c* is installed between the lamps 140 such that lights of the lamps 140 do not interfere with one another. The housing 133 can be integrated with the first and second ribs 131*a* and 132*b* as a single body, and can be also formed separately.

The home appliance having the knob assembly 100 is substantially subjected to a frequent axial weight and impart. For example, when the home appliance is installed, a worker may fall down the home appliance by mistake while transporting the home appliance. Further, while the user turns the knob 120, he and/or she can also excessively apply a lateral force to the knob.

However, since the ribs 131*a* and 132*a* and the extensions 131*b* and 132*b* entirely support the rotary switch 110 in the knob assembly 100, the encoder 111 is destroyed or is not separated from the substrate 10. Further, even the shaft 112 is not deformed even though an excessive lateral force is applied to the knob 120. Furthermore, since the second extension part 132*b* also stably supports the knob 120, the knob 120 is rotated not being shaken, and the user can accurately select his/her desiring function. Accordingly, the inventive knob assembly 100 enhances the home appliance employing it in reliability and stability.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A rotary knob assembly for a home appliance, the assembly comprising:

a rotary switch having an encoder and a shaft rotatably installed at the encoder;

a knob coupled to the shaft of the rotary switch; and a support member provided around the rotary switch to support the rotary switch, wherein the support member is configured to support a side portion of the rotary switch.

2. The assembly of claim 1, wherein the support member supports the rotary switch so as not to be damaged by a force applied to a side surface thereof.

3. The assembly of claim 1, wherein the support member supports the rotary switch or the knob so as not be shaken.

4. The assembly of claim 1, wherein the support member is formed normal to the side of the rotary switch.

5. The assembly of claim 1, wherein the support member is formed to enclose at least a portion of the rotary switch.

6. The assembly of claim 1, wherein the support member is configured to entirely enclose the rotary switch.

7. The assembly of claim 1, wherein the support member is configured to support a side portion of the encoder.

8. The assembly of claim 1, wherein the support member is formed normal to the side portion of the encoder.

9. The assembly of claim 1, wherein the support member is closely in contact with the side portion of the encoder.

10. The assembly of claim 1, wherein the support member has a first rib configured to support at least a portion of the side portion of the encoder.

11. The assembly of claim 10, wherein the first rib is formed normal to the side portion of the encoder.

12. The assembly of claim 10, wherein the first rib is formed to entirely enclose the side portion of the encoder.

13. The assembly of claim 1, wherein the support member has a first extension part extending along the encoder to support the encoder.

14. The assembly of claim 13, wherein the first extension part supports the side portion of the encoder.

15. The assembly of claim 13, wherein the first extension part is formed to enclose the side portion of the encoder.

16. The assembly of claim 1, wherein the support member is configured to support the shaft.

17. The assembly of claim 1, wherein the support member is formed normal to the circumferential portion of the shaft.

18. The assembly of claim 1, wherein the support member has a predetermined clearance with respect to the circumferential portion of the shaft.

19. The assembly of claim 1, wherein the support member has a second rib configured to support at least a portion of the circumferential portion of the shaft.

20. The assembly of claim 19, wherein the second rib is formed normal to the circumferential portion of the shaft.

21. The assembly of claim 19, wherein the second rib is formed to support an upper portion of the encoder.

22. The assembly of claim 19, wherein the second rib is formed to enclose the circumferential portion of the shaft.

23. The assembly of claim 1, wherein the support member has a second extension part extending along the shaft to support the shaft.

24. The assembly of claim 23, wherein the second extension part is formed to enclose the shaft.

25. The assembly of claim 23, wherein the second extension part further extends to reach the knob.

26. The assembly of claim 23, wherein the knob has a boss coupled to the shaft and a reinforcing rib for supporting the boss, and the second extension part is configured to support the boss.

27. The assembly of claim 23, wherein the knob has a boss coupled to the shaft and a reinforcing rib for supporting the boss, and the second extension part is configured to support the reinforcing rib.

28. The assembly of claim 27, wherein the reinforcing rib has a flat portion supported by the second extension part.

29. The assembly of claim 1, wherein the support member is further configured to support the knob.

30. The assembly of claim 1, wherein the support member is configured to support at least one lamp disposed around the knob for displaying an operation status of the home appliance.

31. The assembly of claim 30, wherein the support member has a housing for accommodating the lamp.

32. The assembly of claim 1, wherein the mount member is a substrate.

* * * * *